US006722579B1

(12) United States Patent
Mattes et al.

(10) Patent No.: US 6,722,579 B1
(45) Date of Patent: Apr. 20, 2004

(54) FUEL INJECTION VALVE

(75) Inventors: Patrick Mattes, Stuttgart (DE); Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 80 days.

(21) Appl. No.: 09/830,275

(22) PCT Filed: Aug. 12, 2000

(86) PCT No.: PCT/DE00/02734

§ 371 (c)(1),
(2), (4) Date: Aug. 20, 2001

(87) PCT Pub. No.: WO01/14719

PCT Pub. Date: Mar. 1, 2001

(30) Foreign Application Priority Data

Aug. 25, 1999 (DE) ..... 199 40 293

(51) Int. Cl.[7] ..... F02M 47/02

(52) U.S. Cl. ..... 239/88; 239/124; 239/533.2; 239/584

(58) Field of Search ..... 239/88–98, 124–127, 239/533.2–533.11, 584; 123/467, 506

(56) References Cited

U.S. PATENT DOCUMENTS 5,479,902 A * 1/1996 Wirbeleit et al. ..... 123/498
5,697,554 A * 12/1997 Auwaerter et al. ..... 239/88
5,803,361 A * 9/1998 Horiuchi et al. ..... 239/88

FOREIGN PATENT DOCUMENTS

| | | | |
|---|---|---|---|
| DE | 197 27 896 A | | 1/1999 |
| EP | 0 393 590 A | | 10/1990 |
| EP | 0 459 429 A | | 12/1991 |
| EP | 0 529 630 A | | 3/1993 |
| EP | 0 829 641 A | | 3/1998 |
| WO | WO 94/19598 | * | 9/1994 |

* cited by examiner

*Primary Examiner*—Dinh Q. Nguyen
(74) *Attorney, Agent, or Firm*—Ronald E. Greigg

(57) ABSTRACT

In a fuel injection valve having a valve body, which contains a movable injector needle, having an actuating part, which supports the injector needle and communicates with a control pressure chamber, and having a compensation chamber, which communicates with a compensation piston, a closing force that counteracts a dynamic opening force should be reliably exerted on the actuating part. To this end, a spring element that exerts a compensating force on the injector needle is disposed between the injector needle and the compensation piston.

15 Claims, 3 Drawing Sheets

FUEL INJECTION VALVE

CROSS-REFERENCE TO RELATED APPLICATIONS

This application is a 35 USC 371 application of PCT/DE 00/02734 filed on Aug. 12, 2000.

BACKGROUND OF THE INVENTION

1. Field of the Invention

The invention relates to a fuel injection valve having a valve body, which contains a movable injector needle, an having actuating part, which supports the injector needle and communicates with a control pressure chamber, and having a compensation chamber, which communicates with a compensation piston.

2. Description of the Prior Art

A fuel injection valve of the type with which this invention is concerned has been disclosed by DE 197 27 896 A1. In this known valve, the compensation chamber is used to compensate for an opening force which acts on the injector needle after it opens. This occurs because when the injector needle lifts up from its valve seat, an additional area is acted on by high-pressure so that forces that increase up to a limit value act on the injector needle in the opening direction. In order to compensate for the opening force, a compensating force which counteracts the opening force is produced in the compensation chamber. In the known fuel injection valve, the actuating part is provided with an annular shoulder that is disposed inside the compensation chamber. The compensation chamber is filled with a fluid, for example the fuel to be injected, so that a hydraulic chamber is produced which is closed but whose volume can be displaced by the movement of the compensation piston. When the injector needle is open, the actuating part is pushed further into the compensation chamber so that because of the annular shoulder, the fuel in the compensation chamber is displaced. This displacement initially produces a pressure increase in the compensation chamber due to the rigidity of the hydraulic volume and the elastic properties of the fuel contained therein. After this initial pressure increase, the volume of the compensation chamber is displaced as a result of which the compensation piston is also moved. The force counteracting this movement acts as a closing force on the actuating member. The progression and amount of closing force can be adjusted by means of the volume of the compensation chamber and the embodiment and impingement of the compensation piston.

SUMMARY OF THE INVENTION

The fuel injection valve according to the invention has the advantage that the compensating force can be produced in a simpler manner without the need for a hydraulic chamber between the actuating part and the compensation piston. In particular, this eliminates all the problems that stem from the use of a hydraulic fluid, namely supplying the hydraulic fluid and preventing unintentional escape of the hydraulic fluid.

According to a preferred embodiment of the invention, the spring element is constituted by at least one Belleville washer, or disk spring. A disk spring or a disk spring packet has the advantage that it produces a characteristic curve which, in a particular range, demonstrates a very small increase in the spring force over the spring travel. As a result, an essentially constant closing force can be produced.

According to a preferred embodiment of the invention, the compensation piston is disposed concentric to the longitudinal axis of the actuating part. This produces a particularly compact design of the fuel injection valve.

According to one variant, the compensation piston is annular and encompasses the actuating part, the compensation chamber is an annular chamber which encompasses the actuating part and is closed at one end by the compensation piston, and the actuating part is provided with a collar which supports the spring. This embodiment produces a design of the fuel injection valve that is very compact in the axial direction.

According to another variant, at the end remote from the injector needle, the actuating part is provided with a support disk, which supports the spring, and the support disk is disposed opposite from the compensation piston which, at its end remote from the injector needle, is provided with an extension that closes one end of the compensation chamber. This embodiment produces a design of the fuel injection valve that is slender in the radial direction.

Preferably, two stops for the compensation piston are embodied on the valve body, which determine the end positions of the compensation piston. Consequently, in the event of an excessively high or excessively low pressure in the compensation volume, there are preset positions the compensation piston which assure a correct operation of the fuel injection valve.

BRIEF DESCRIPTION OF THE DRAWINGS

The invention will be described below with reference to two preferred embodiments that are shown in the accompanying drawings, in which.

DESCRIPTION OF THE PREFERRED EMBODIMENTS

Figure 1:
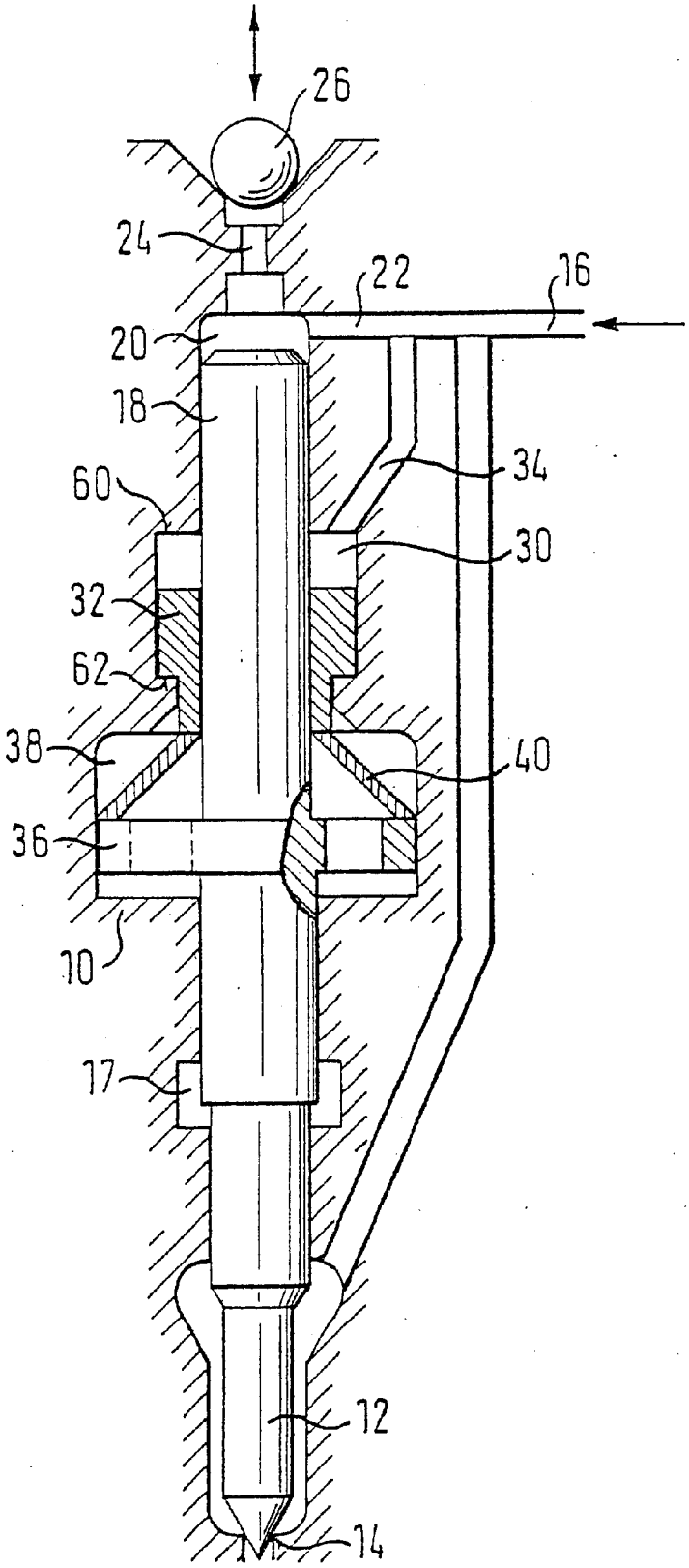
FIG. 1 is a schematic sectional view of a first embodiment of a fuel injection valve according to the invention.

FIG. 1 shows a 2/2-way fuel injection valve for a so-called "common rail" injection system. The injection valve has a valve body 10 which contains a movable injector needle 12. The injector needle cooperates with a valve seat 14 in order to control the injection of fuel, which is supplied via a supply line 16, into a cylinder of an internal combustion engine, not shown.

An actuating part 18 is supported on the injector needle 12 and its end face remote from the injector needle 12 closes a control pressure chamber 20. An annular leakage collecting chamber 17 is embodied in the valve body 10 and encompasses the actuating part 18. A feed line 22 connected to the supply line 16 leads to the control pressure chamber 20 and contains an inlet throttle. An outlet line 24 leads from the control pressure chamber 20, has an outlet throttle disposed in it, and is controlled by a control valve 26.

When the control valve 26 is closed, the fuel pressure prevailing in the control pressure chamber 20 produces a closing force that is greater than an opening force produced by the fuel in the vicinity of the injector needle 12. The injector needle 12 consequently rests against the valve seat 14 and no fuel is injected. When the control valve 26 is open, the escaping fuel causes the pressure in the control pressure chamber to decrease so that the opening force produced in the vicinity of the injector needle 12 becomes greater than the closing force produced in the vicinity of the control pressure chamber 20. Consequently, the injector needle 12 can lift up from the valve seat 14 and fuel is injected. When the control valve 26 is closed again, a closing force is once again exerted on the actuating member 18 which causes the injector needle 12 to close.

When the injector needle 12 lifts up from the valve seat 14, an additional area is produced that is acted on by the fuel pressure, as a result of which an additional opening force is produced. This opening force has a dynamic progression and is shown by way of example in FIG. 3 for four different fuel pressures in the common rail injection system by the curves 1, 2, 3, and 4. In order to counteract this additional opening force, a compensation system is provided which exerts a compensating force on the actuating member.

The compensation system is comprised of an annular compensation chamber 30, which encompasses the actuating member 18 and is closed at one end by an annular compensation piston 32. The compensation chamber 30 communicates with the supply line 16 via a feed line 34.

The actuating part 18 is provided with a collar 36 which is disposed in a spring chamber 38. A spring disk packet 40 is disposed between the collar 36 and the end face of the compensation piston 32 oriented toward the injector needle 12. The spring disk packet has a spring rigidity of approximately 4 N per micrometer.

Figure 3:
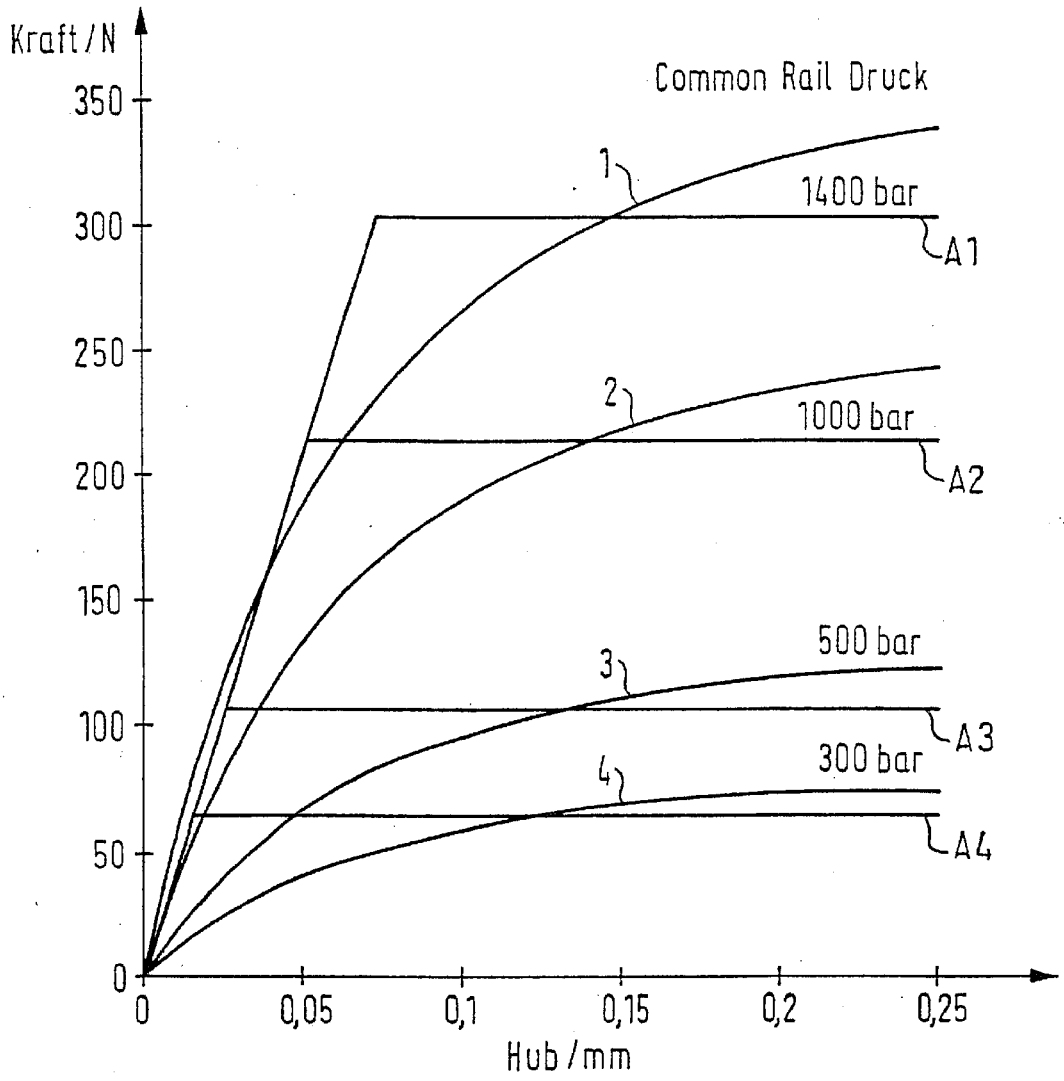
FIG. 3 shows the progression of the dynamic opening force for a fuel injection valve according to the invention.

When the injector needle 12 opens, the spring disk packet 40 is initially compressed by means of the collar 36. This produces a compensating force which increases sharply as a function of the spring rigidity of the spring disk packet 40. In FIG. 3, this is shown on the left side of the curve A for the compensating force.

As soon as a predetermined amount of force is produced, the compensation piston 32 moves in the compensation chamber counter to the compressive force produced by the fuel in the compensation chamber 30. The movement of the piston 32 assures that the compensating force is kept at a constant level. This is depicted by the horizontal part of the curve A in FIG. 3. On the whole, a compensating force is thus produced which depends on the pressure in the supply line 16 and compensates for the dynamic opening force.

Figure 2:
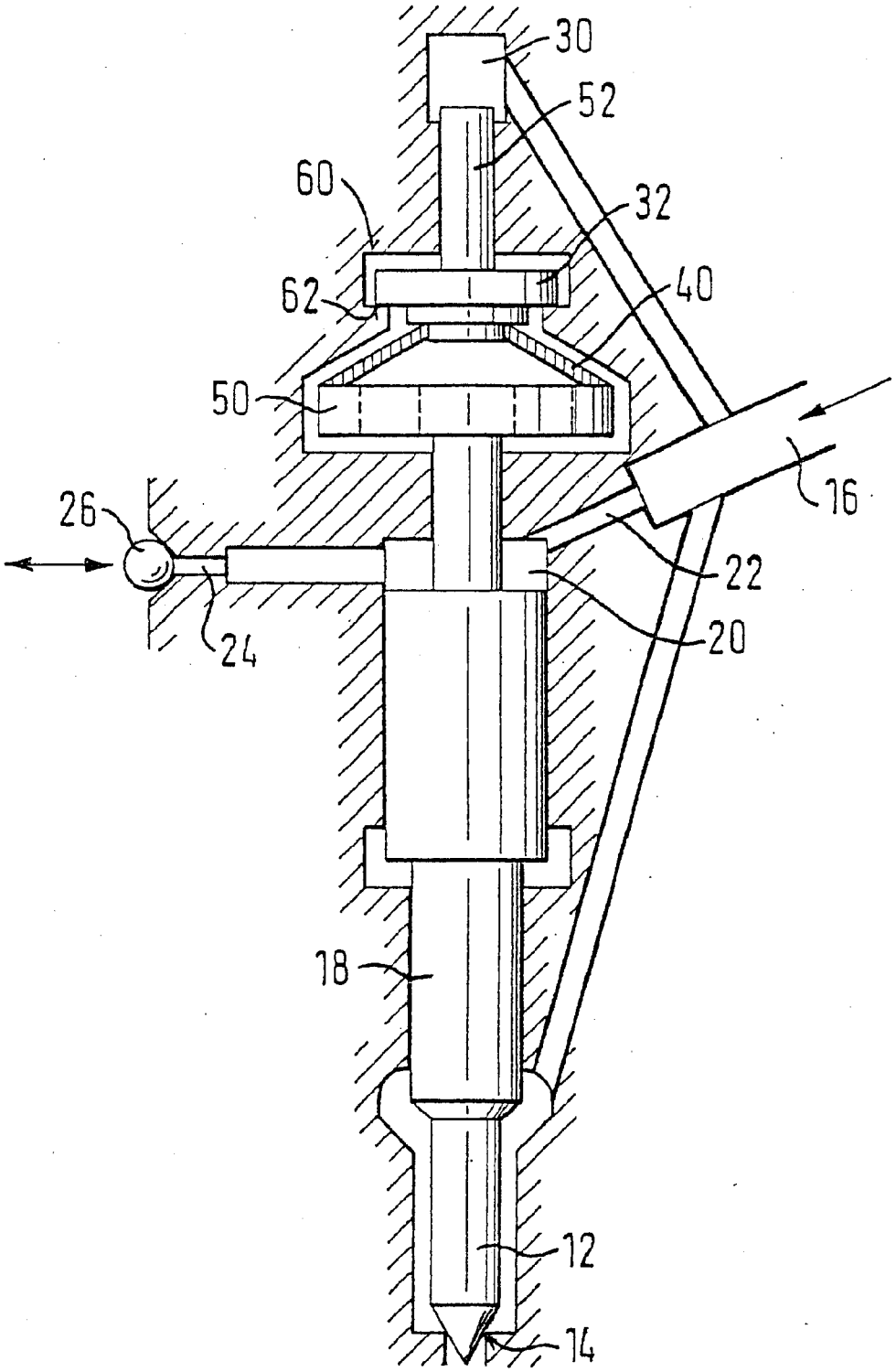
FIG. 2 is a schematic sectional view of a second embodiment of a fuel injection valve according to the invention.

FIG. 2 shows a second embodiment of a fuel injection valve according to the invention. It differs from the first embodiment in terms of the embodiment of the compensation system.

The actuating part 18 is provided with a support disk 50 on which the disk spring 40 rests. The compensation piston 32, which is provided with an extension 52, is disposed opposite the support disk 50. This extension 52 closes one end of the compensation chamber 30.

The function of the compensation system corresponds to that of the compensation system in the first embodiment.

One advantage resulting from the use of the mechanical spring 40 is that there are no losses over time during the opening of the valve. Furthermore, during the opening of the injector needle 12, potential energy which is needed later for the closing is temporarily stored in the spring.

Valve body 10 has two stops 60, 62 embodied in it which determine the end positions for the compensation piston 32. The stops assure that it is possible for the compensation system to function even when there is an excessively high or excessively low pressure in the supply line 16.

The foregoing relates to a preferred exemplary embodiment of the invention, it being understood that other variants and embodiments thereof are possible within the spirit and scope of the invention, the latter being defined by the appended claims.

We claim:

1. In a fuel injection valve having a valve body (10), which contains a movable injector needle (12), having an actuating part (18), which supports the injector needle (12) and which delimits a control pressure chamber (20) having an inlet and an outlet line of pressurized fuel and a control valve in one of them to change the effective pressure in the control chamber for actuation of the actuating part of the injector needle, said fuel injection valve having further a compensation chamber (30) exposed to the pressurized fuel and delimited by a compensation piston (32), which further acts under the pressure of the compensation chamber via a spring element (40) on the injector needle in its closing direction generating a compensation force on that needle.

2. The fuel injection valve according to claim 1, wherein the spring element is constituted by at least one spring disk (40).

3. The fuel injection valve according to claim 2, wherein the compensation piston (32) is disposed concentric to the longitudinal axis of the actuating part (18).

4. The fuel injection valve according to claim 3, wherein the compensation piston (32) is annular and encompasses the actuating part (18), that the compensation chamber (30) is an annular chamber which encompasses the actuating part (18) and is closed at one end by the compensation piston (32), and that the actuating part (18) is provided with a collar (36) which supports the spring element.

5. The fuel injection valve according to claim 3, wherein on the end remote from the injector needle (12), the actuating part (18) is provided with a support disk (50) which supports the spring element (40), and that the support disk (50) is disposed opposite from the compensation piston (32) which, on its end remote from the injector needle (12), is provided with an extension (52) which closed one end of the compensation chamber (30).

6. The fuel injection valve according to claim 5, wherein two stops (60, 62) for the compensation piston (32) are embodied on the valve body (10), which determine the end positions of the compensation piston (32).

7. The fuel injection valve according to claim 3, wherein two stops (60, 62) for the compensation piston (32) are embodied on the valve body (10), which determine the end positions of the compensation piston (32).

8. The fuel injection valve according to claim 2, wherein two stops (60, 62) for the compensation piston (32) are embodied on the valve body (10), which determine the end positions of the compensation piston (32).

9. The fuel injection valve according to claim 1, wherein the compensation piston (32) is disposed concentric to the longitudinal axis of the actuating part (18).

10. The fuel injection valve according to claim 9, wherein the compensation piston (32) is annular and encompasses the actuating part (18), that the compensation chamber (30) is an annular chamber which encompasses the actuating part (18) and is closed at one end by the compensation piston (32), and that the actuating part (18) is provided with a collar (36) which supports the spring element.

11. The fuel injection valve according to claim 10, wherein two stops (60, 62) for the compensation piston (32) are embodied on the valve body (10), which determine the end positions of the compensation piston (32).

12. The fuel injection valve according to claim 9, wherein on the end remote from the injector needle (12), the actuating part (18) is provided with a support disk (50) which supports the spring element (40), and that the support disk (50) is disposed opposite from the compensation piston (32) which, on its end remote from the injector needle (12), is provided with an extension (52) which closed one end of the compensation chamber (30).

13. The fuel injection valve according to claim 12, wherein two stops (60, 62) for the compensation piston (32) are embodied on the valve body (10), which determine the end positions of the compensation piston (32).

14. The fuel injection valve according to claim 9, wherein two stops (60, 62) for the compensation piston (32) are embodied on the valve body (10), which determine the end positions of the compensation piston (32).

15. The fuel injection valve according to claim 1, wherein two stops (60, 62) for the compensation piston (32) are embodied on the valve body (10), which determine the end positions of the compensation piston (32).

* * * * *